United States Patent [19]

Carratala et al.

[11] 4,077,593

[45] Mar. 7, 1978

[54] HOLDER FOR A PLANT CONTAINER

[76] Inventors: Alfredo Carratala, 301 NW. 47th Ave., Miami, Fla. 33126; Julio Palomino, 19 Samana Dr., Miami, Fla. 33133

[21] Appl. No.: 791,723

[22] Filed: Apr. 28, 1977

[51] Int. Cl.[2] ..... A47G 7/02

[52] U.S. Cl. ..... 248/146; 47/41 R; 312/351

[58] Field of Search ..... 312/350, 351, 206, 207; 47/41; 206/426; 248/27.8, 154, 146

[56] References Cited

U.S. PATENT DOCUMENTS

| | | | |
|---|---|---|---|
| 2,608,459 | 8/1952 | Malmquist | 312/351 |
| 3,661,350 | 5/1972 | Eckler et al. | 248/146 |

*Primary Examiner*—Paul R. Gilliam

*Assistant Examiner*—Alex Grosz

[57] ABSTRACT

A weighted holder for plant containers such as vases and urns having pedestal base portions of varying heights. An interior chamber of a base portion of the holder is filled with a heavy material such as sand; opposed upwardly extending side walls from the base are provided with pluralities of pairs of horizontal parallel grooves for selective sliding reception of a shelf. The shelf and a top wall connecting between the side walls are oppositely slotted with the top wall slot terminating in a central annular hole to nest the bottom portion of the main body portion of the container. The shelf is slidable into any of the pairs of parallel grooves to permit engagement thereof over the base of the pedestal with the stem thereof passing upwardly through the shelf slot.

5 Claims, 2 Drawing Figures

HOLDER FOR A PLANT CONTAINER

BACKGROUND OF THE PRESENT INVENTION

The delivery of plants to customers by florists, nurseries, etc. in delivery vehicles presents a substantial problem because of the fragile nature of many of the plant containers, particularly vases, urns and the like which have pedestal bases. Obviously, containers of this type must be afforded a substantial degree of protection in a moving vehicle.

The present invention provides a weighted holder for containers having pedestal bases. A bottom chamber formed in the holder is filled with a heavy material such as sand for stability, and adjustment means is provided to accommodate and confine containers having pedestal bases of varying heights.

Therefore, one of the principal objects of the present invention is to provide holder means for plant containers of the type provided with pedestal bases, to captivate the container against movement while being delivered to a customer in a moving vehicle.

Another object of the invention is to provide adjustment means for the holder to accommodate plant containers having pedestal bases of varying heights.

A further object of the invention is to provide means to stabilize the holder such as a bottom chamber filled with a heavy material, sand, for example.

DETAILED DESCRIPTION OF THE DRAWINGS

Figure 1:
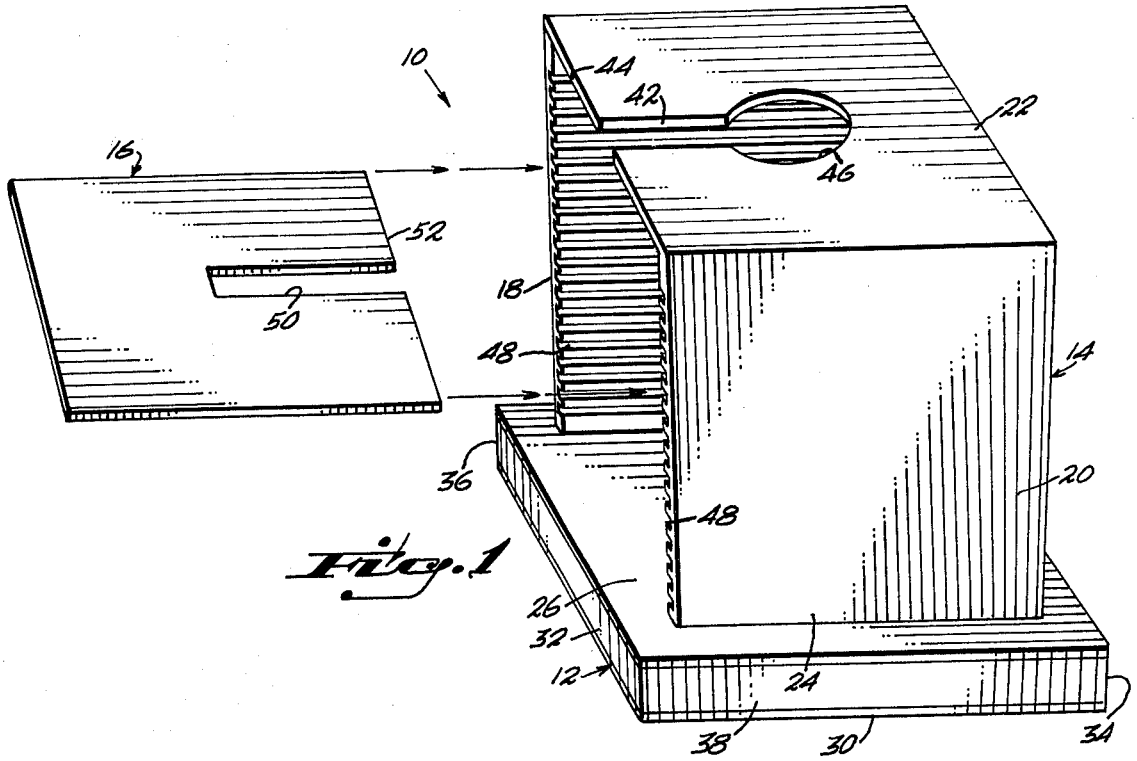
FIG. 1 is an exploded perspective view of the plant container holder of the present invention.
Figure 2:
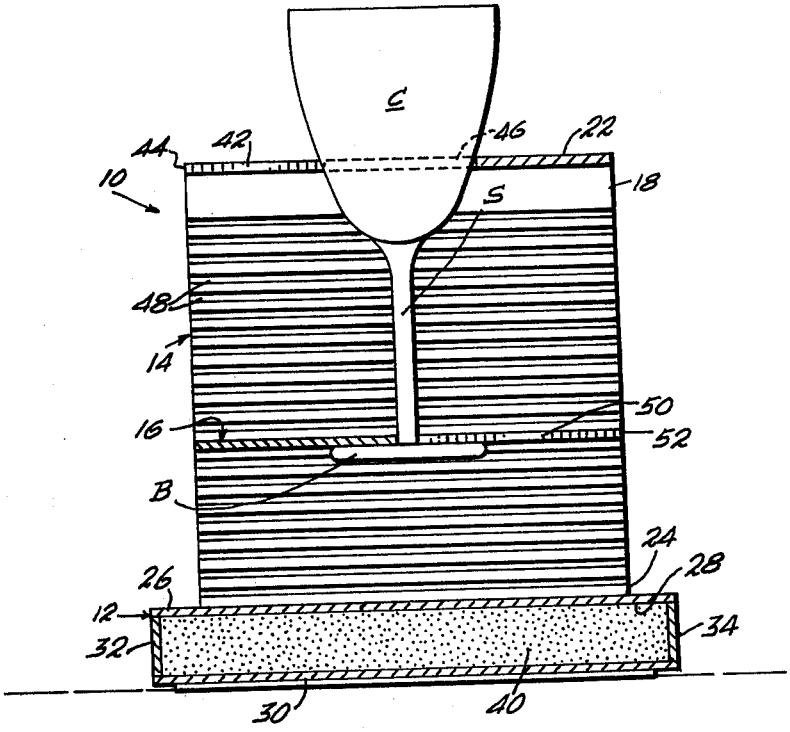
FIG. 2 is a vertical, longitudinal sectional view of the holder in accordance with the present invention with a plant container having a pedestal base engaged therein.

With reference to the drawings in which like reference characters designate like or corresponding parts throughout the two views and with particular reference to FIG. 1, the plant container holder, indicated generally at 10, is comprised of a base portion 12, a top portion 14 and a shelf 16. The top portion 14 is generally of an inverted U-configuration providing a pair of side walls 18 and 20, and a top wall 22. The lower end portions 24 of each side wall may be secured to the top plate 26 of base portion 12 in any conventional manner, for example, when the structure is fabricated of a sheet plastic material, a suitable plastic cement may be utilized.

Base portion 12 provides an inner chamber 28 defined by the top plate 26, a bottom plate 30, front and rear walls 32, 34, and side walls 36, 38. Inner chamber 28 is filled with a suitable heavy material such as sand 40.

Top wall 22 is longitudinally slotted at 42 from the front edge 44 to an enlarged central annular opening 46.

The side walls 18 and 20 are provided with a plurality of vertically aligned inwardly confronting pairs of longitudinally extending parallel grooves 48 to slidably receive the shelf 16. Therefore, the shelf 16 may be selectively positioned at varying distances below the top wall 22 as determined by the pair of vertically aligned grooves 48 in which the shelf 16 is positioned. Shelf 16 is inwardly slotted at 50 from the back edge 52 thereof to a distance somewhat beyond the center point of said shelf, slot 50 being longitudinally aligned with slot 42.

In use, the main body portion of a container C is nested in the central annular opening 46 by passing the stem S thereof through the top wall slot 42. Shelf 16 is then slid in the pair of grooves 48 which will place it immediately atop the container support base B with stem S extending through slot 50. Therefore, it can be seen that the container is captivated against vertical and horizontal movements and the sand 40 in base portion 12 stabilizes the holder 10 against the forces generated by the normal movements of a delivery vehicle.

What is claimed is:

1. A holder for a pedestal type container having an upper main body container portion and a stem connecting between the main body portion and a support base, said holder comprising:

a base portion, a pair of spaced apart, upstanding parallel walls, including bottom end portions fixed to said base portion, and top end portions, a top wall spanning the distance between and fixed to said top end portions, a plurality of vertically aligned inwardly confronting pairs of longitudinally extending parallel grooves in said side walls, means to supportingly nest the upper main body portion of the holder in said top wall, a shelf for selective sliding engagement in any of said pairs of vertically aligned parallel grooves, means to permit said shelf to engage over the container support base to confine the main body portion in said nested position.

2. The holder as defined in claim 1 including a longitudinally extending slot and a central annular opening, comprising said means to nest, in said top wall, said top wall including a front edge and said slot extending from said front edge to said annular opening.

3. The holder as defined in claim 2 wherein said shelf includes a back edge, and said means to permit comprises a slot in said shelf from said back edge in longitudinal alignment with said top wall slot to a predetermined depth.

4. The holder as defined in claim 1 wherein said base portion includes an interior chamber.

5. The holder as defined in claim 4 wherein said interior chamber is filled with a heavy material such as sand.

* * * * *